US007647977B2

(12) United States Patent
Hall et al.

(10) Patent No.: US 7,647,977 B2
(45) Date of Patent: Jan. 19, 2010

(54) BOREHOLE LINER

(76) Inventors: David R. Hall, 2185 S. Larsen Pkwy., Provo, UT (US) 84606; John Fernandez, 2185 S. Larsen Pkwy., Provo, UT (US) 84606; Joe Fox, 2185 S. Larsen Pkwy., Provo, UT (US) 84606

( * ) Notice: Subject to any disclaimer, the term of this patent is extended or adjusted under 35 U.S.C. 154(b) by 369 days.

(21) Appl. No.: 11/828,848

(22) Filed: Jul. 26, 2007

(65) Prior Publication Data

US 2009/0025942 A1 Jan. 29, 2009

(51) Int. Cl.
*E21B 17/22* (2006.01)
*F16L 55/1645* (2006.01)

(52) U.S. Cl. ..... 166/380; 166/242.1; 166/385; 405/184.2

(58) Field of Classification Search ..... 166/380, 166/378, 385, 231, 242.1; 405/154.1, 156, 405/184.2; 242/441.2, 441.4, 471
See application file for complete search history.

(56) References Cited

U.S. PATENT DOCUMENTS

| | | | |
|---|---|---|---|
| 341,327 | A | 5/1886 | Fay |
| 2,143,072 | A | 1/1939 | Johnson |
| 3,364,993 | A | 1/1968 | Skipper |
| 4,544,041 | A | 10/1985 | Rinaldi |
| 4,865,127 | A | 9/1989 | Koster |
| 4,913,758 | A | 4/1990 | Koster |
| 4,971,152 | A | 11/1990 | Koster |
| 4,995,929 | A | 2/1991 | Menzel |
| 5,046,558 | A | 9/1991 | Koster |
| 5,101,863 | A | 4/1992 | Fujii |
| 5,271,472 | A | 12/1993 | Leturno |
| 5,454,419 | A | 10/1995 | Vloedman |
| 5,799,701 | A | 9/1998 | Kitahashi |
| 6,234,226 | B1 | 5/2001 | Kitahashi |
| 6,250,385 | B1 | 6/2001 | Montaron |
| 6,637,092 | B1 | 10/2003 | Menzel |
| 6,640,903 | B1 | 11/2003 | Cook |
| 6,675,901 | B2 | 1/2004 | Johnson |
| 6,679,334 | B2 | 1/2004 | Johnson |
| 6,705,395 | B2 | 3/2004 | Cook |
| 6,725,919 | B2 | 4/2004 | Cook |
| 7,048,067 | B1 | 5/2006 | Cook |
| 7,134,495 | B2 | 11/2006 | Vloedman |

*Primary Examiner*—Daniel P Stephenson
(74) *Attorney, Agent, or Firm*—Tyson J. Wilde; Jad A. Mills

(57) ABSTRACT

A system for forming a liner downhole within a well bore has a rig comprising a tool string driving mechanism and an aperture proximate an opening of a well bore. The system also has first and second tool string components and each component has a central bore disposed intermediate first and second tool joints of the component. The first tool joint of the first component is disposed proximate the aperture and the second tool joint of the second component. First and second resilient lining materials are disposed within the central bore of the first and second tool string components respectively. At least one lining material connecting mechanism is disposed proximate the aperture. The system also comprises at least one downhole dispenser that is adapted to direct a resilient continuous lining material against the well bore to form a liner.

20 Claims, 17 Drawing Sheets

BOREHOLE LINER

BACKGROUND OF THE INVENTION

This invention relates to downhole drilling, specifically in relation to oil, gas and geothermal drilling. More specifically this invention relates to forming a bore hole liner during the drilling of a well bore.

Liners, such as casing, may be used to separate the annulus of a well bore from fluid communication with the surrounding formation. Well bore isolation may be advantageous both in the interests of protecting the well bore from infiltration by water or other compounds in the surrounding formation, and in protecting the environment surrounding the well bore from infiltration with drilling materials or environmental hazards. Various methods of lining well bores are known in the art, many of which include conveying a liner downhole and securing it to the well bore wall. Methods or systems for casing or lining well bores are disclosed in U.S. Pat. Nos. 4,544,041; 5,271,472; 5,454,419; 6,640,903; 6,725,919; 7,048,067; and 7,134,495, each of which is incorporated by reference for all that it contains. Many methods of casing well bores may require complete or partial removal of the drill string in order to case the well. Faster and more efficient means of conveying a casing or lining downhole and securing it to the well bore wall have been sought in order to minimize the time and money lost by casing or lining operations.

Methods or systems for using a wound strip to form a liner are disclosed in U.S. Pat. Nos. 4,913,758; 4,971,152; 6,637,092; 5,799,701; and 4,995,926; each of which is hereby incorporated by reference for all that it contains.

U.S. Pat. No. 6,675,901 to Johnson et al, which is hereby incorporated by reference for all that it contains, discloses A system that is useable in a subterranean well includes a tubular structure that is formed from a spirally wound strip, and the tubular structure is provided downhole in the subterranean well.

U.S. Pat. No. 6,679,334 to Johnson et al, which is hereby incorporated by reference for all that it contains, discloses a system that is useable in a subterranean well includes conveying an elongated strip from a surface of the well downhole into the well; and spirally wrapping the strip to form a tubular structure in the well.

FIG. 1a depicts a system 1105 from U.S. Pat. No. 6,679,334 which discloses that may be used to deploy the strip 10 downhole inside a wellbore 1107. The system 1105 includes a truck 1114 that contains a spool 1112 of tubing 1106 that is deployed downhole into the well through a well tree 1122. A winding machine assembly 1108 is attached to the lower end of the tubing 1106 and is used to form a tubular structure inside the wellbore from the strip 10.

FIG. 1b depicts another system 150 from U.S. Pat. No. 6,679,334 which discloses deploying the strip 10 downhole and forming the tubular structure downhole. In this embodiment, the strip 10 is deployed in its linear configuration into an annulus of the well from a spool 160 that is located at the surface of the well. The annulus is formed in the annular region between a tubing 166 that extends down into a wellbore and the interior wall of the wellbore. The lower end of the tubing 166 may be attached to a side entry sub 167 that couples the tubing 166 to a tubular section 168 of pipe in which the strip 10 is allowed to coil. In this manner, the side entry sub 167 provides a side entry port to the interior passageway of the section 168 through which the strip 10 is threaded.

FIG. 1c depicts yet another system 180 from U.S. Pat. No. 6,679,334 for deploying the strip 10. At the surface of the well, tubing 184 is unrolled from a tubing spool 182 (located on a truck 186) and may be fed through a rotary drive mechanism 188 (that is capable of turning the tubing 184) and through a well tree 192 into the well. At the surface of the well, the tubing 184 also passes through a mechanism 190 that receives the strip 10 from a coil 206 and wraps the strip around the tubing 184. The tubing 184 with the wrapped strip 10 is deployed downhole. The lower end of the tubing 184 is connected to the rotating head 132 that winds the strip 10 off of the tubing 184 and spiral wraps the strip 10 to form a tubular structure downhole in a particular section 1200 of the wellbore.

BRIEF SUMMARY OF THE INVENTION

In one aspect of the invention, a system for forming a liner downhole within a well bore comprises a rig having a tool string driving mechanism and an aperture proximate an opening of a well bore. The system also comprises first and second tool string components and each component comprises first and second tool joints of the component. The first tool joint of the first component is disposed proximate the aperture and the second tool joint of the second component. First and second resilient lining materials are disposed within central bores of the first and second tool string components respectively. At least one lining material connecting mechanism is disposed proximate the aperture. The system also comprises at least one downhole dispenser that is adapted to direct a resilient continuous lining material against the well bore. By connecting the first and second lining materials the connecting mechanism a resilient continuous lining material is formed. The liner may be a well-casing, a patch, a barrier or combinations thereof. The liner may comprise a continuous length of at least 40 feet. The lining material may be selected from the group consisting of strips, tubes, split tubes, corrugated tubes, wires, braded wires, cables, and combinations thereof.

The present invention provides the advantage of protecting to the lining material during the drilling process. U.S. Pat. No. 6,679,334 to Johnson et al discloses a mechanism to convey an elongated strip from a surface of the well downhole into the well. Such a system as described by Johnson leaves his strip vulnerable to damage from getting caught in the wellbore wall, from getting hit by cuttings in the drilling mud, from getting wrapped around the drill string, and from getting pinched between the wellbore wall and the drill string. Johnson's strip is conveyed downhole in the wellbore all the way to the tubular structure or it is at some point taken from the wellbore into the bore of the drill string once it is already in downhole. The present invention on the other hand conveys a lining material from the surface directly into the bore of the tool string, not directly into the wellbore. Such a system protects the lining material from the adverse conditions which Johnson allows his strip to be exposed to. Further, in the present invention, the mechanisms for forcing the lining material against the wellbore wall are located within the tool string bore.

In some embodiments the system may comprise a lining material cutting mechanism that is disposed proximate the aperture. First and second portions of one resilient lining material may be detached from one another by the cutting mechanism and become respectively the first and second resilient lining materials. The first and second resilient lining materials may each comprise steel, 1095 steel, spring steel, a nickel alloy, aluminum, plastic, polymers, shape memory alloy metals, or combinations thereof.

The resilient continuous lining material may extend from within the driving mechanism and through the bores of both the first and second components. In some embodiments the lining material may extend from the driving mechanism to the downhole dispenser disposed within at least one component of the tool string. The continuous lining material may comprise a lining material thickness of between 0.008 and 0.25 inches. It also may comprise a total lining material width and a dent width, the dent width being at least one fifth of the total lining material width.

The dispenser may comprise at least one guide block disposed within an outer diameter of a downhole component, which guide block changes a direction of flow of the resilient continuous lining material by between 65 and 115 degrees. The dispenser may be powered by a downhole mud motor or by rotation of the tool string caused by the driving mechanism. In some embodiments the dispenser comprises an input switch that allows a power source for the dispenser to change between a downhole mud motor and the driving mechanism.

In another aspect of the invention a method of forming a liner downhole within a well bore comprises a step of providing first and second tool string components at a surface rig, each component comprising a central bore disposed and also providing first and second resilient lining materials, the first lining material being disposed within the first component such that a first end is proximate the first tool joint. The method further comprises a step of positioning a second end of the second lining material proximate the first lining material's first end by passing the second end from the second component's first tool joint to its second tool joint through its central bore. The method also comprises steps of connecting the first end to the second end to form a resilient continuous lining material and mechanically coupling the first tool joint of the first component to the second tool joint of the second component. The method further comprises directing the continuous lining material against the well bore.

The step of positioning the second end of the second lining material proximate the first end of the first lining material may further comprise retaining the first lining material proximate the first tool joint of the first component while passing the second lining material through the central bore of the second component. The step of conveying the first lining material downhole may comprise using at least one roller, pulley, spool, deflection plate, deflection piston, motor, cam shaft, magnet, or combinations thereof. The step of connecting the first and second lining materials may comprise welding, crimping, indenting, hooking, heating, or combinations thereof. In some embodiments the step of providing first and second resilient lining materials may further comprises cutting one resilient continuous lining material that extends from a tool string driving mechanism into the central bore of the first component into a first portion and a second portion. The first and second portions may be detached from one another by cutting, snipping, crimping, sawing, bending, heating, unhooking, using a water jet cutter, using a sheer cutter, or combinations thereof.

In another aspect of the present invention a drill string for forming a subterranean borehole has a central bore and a borehole lining material disposed within the drill string's central bore. The drill string further comprises a mechanism for threading the lining material through the central bore and depositing the lining material against a wall of the borehole.

DETAILED DESCRIPTION OF THE INVENTION AND THE PREFERRED EMBODIMENT

Figure 1:
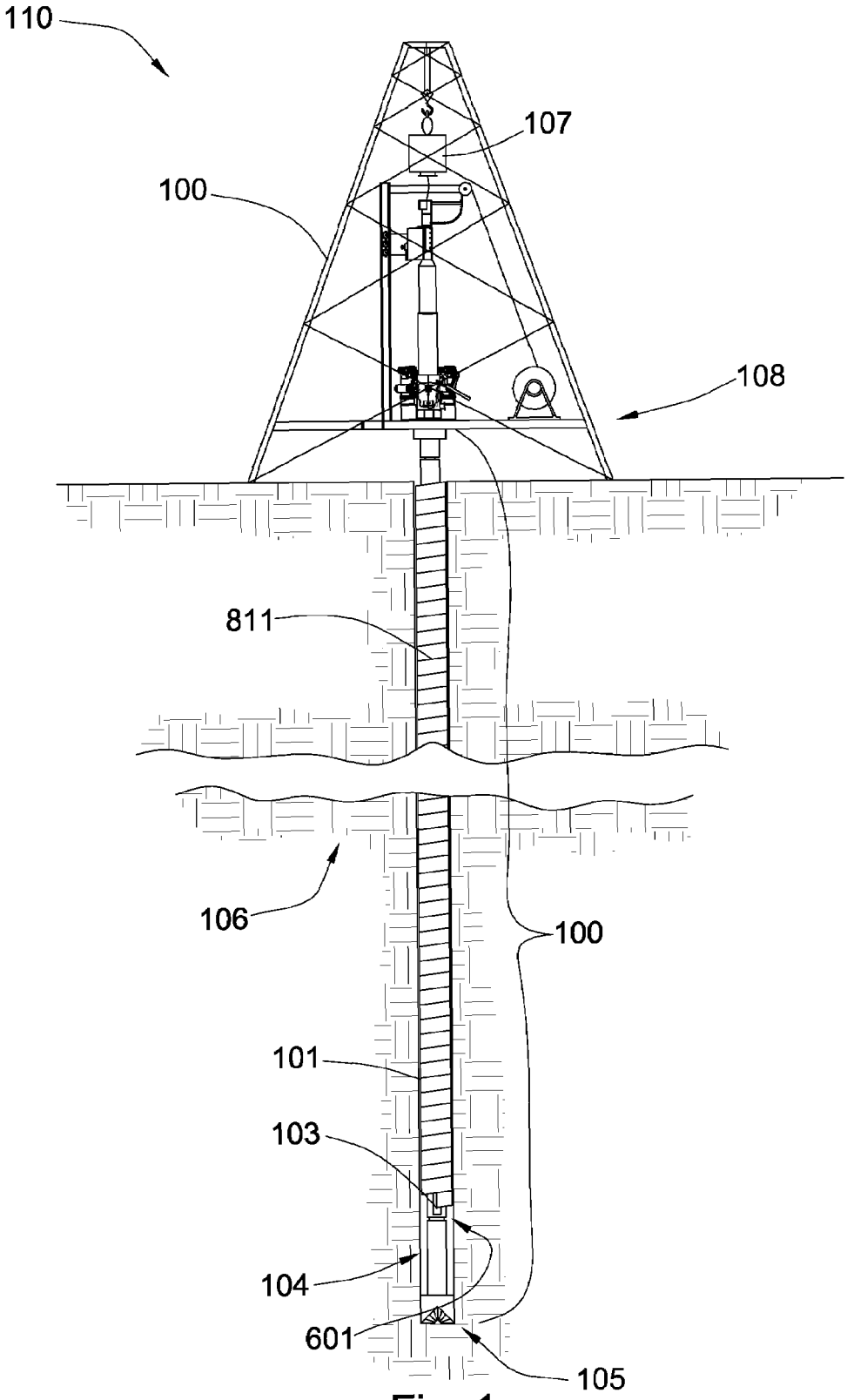
FIG. 1 is a cross-sectional diagram of an embodiment of a drill string suspended in a bore hole.
Figure 1A:
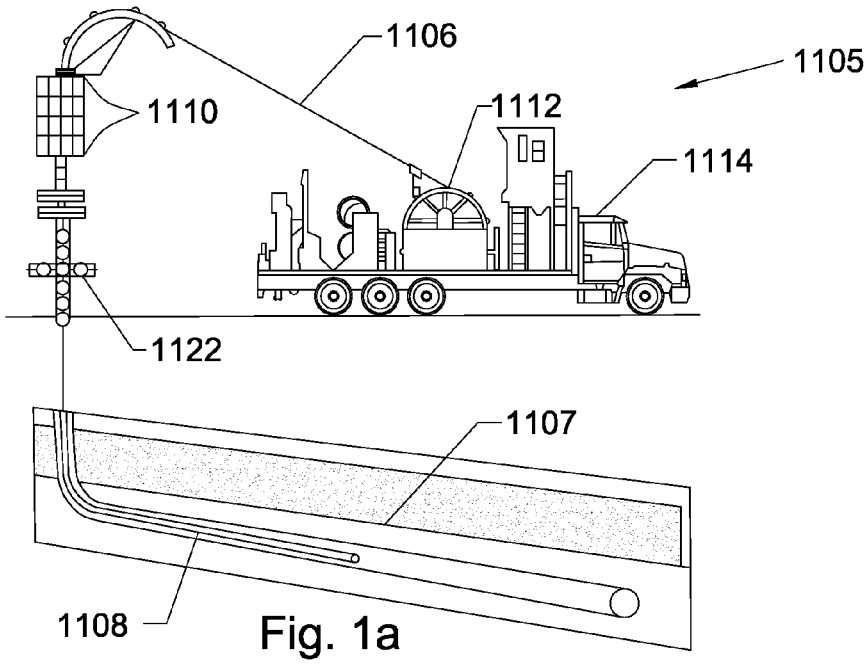
Fig. 1a PRIOR ART
Figure 1B:
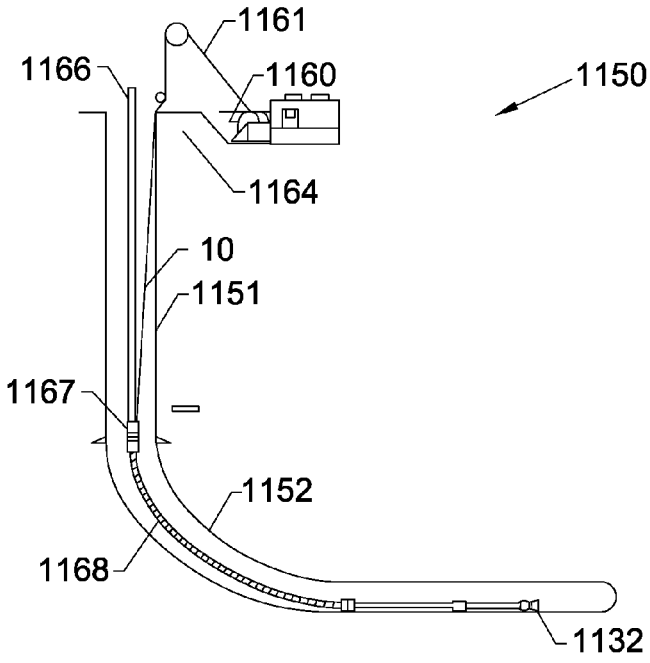
Fig. 1b PRIOR ART
Figure 1C:
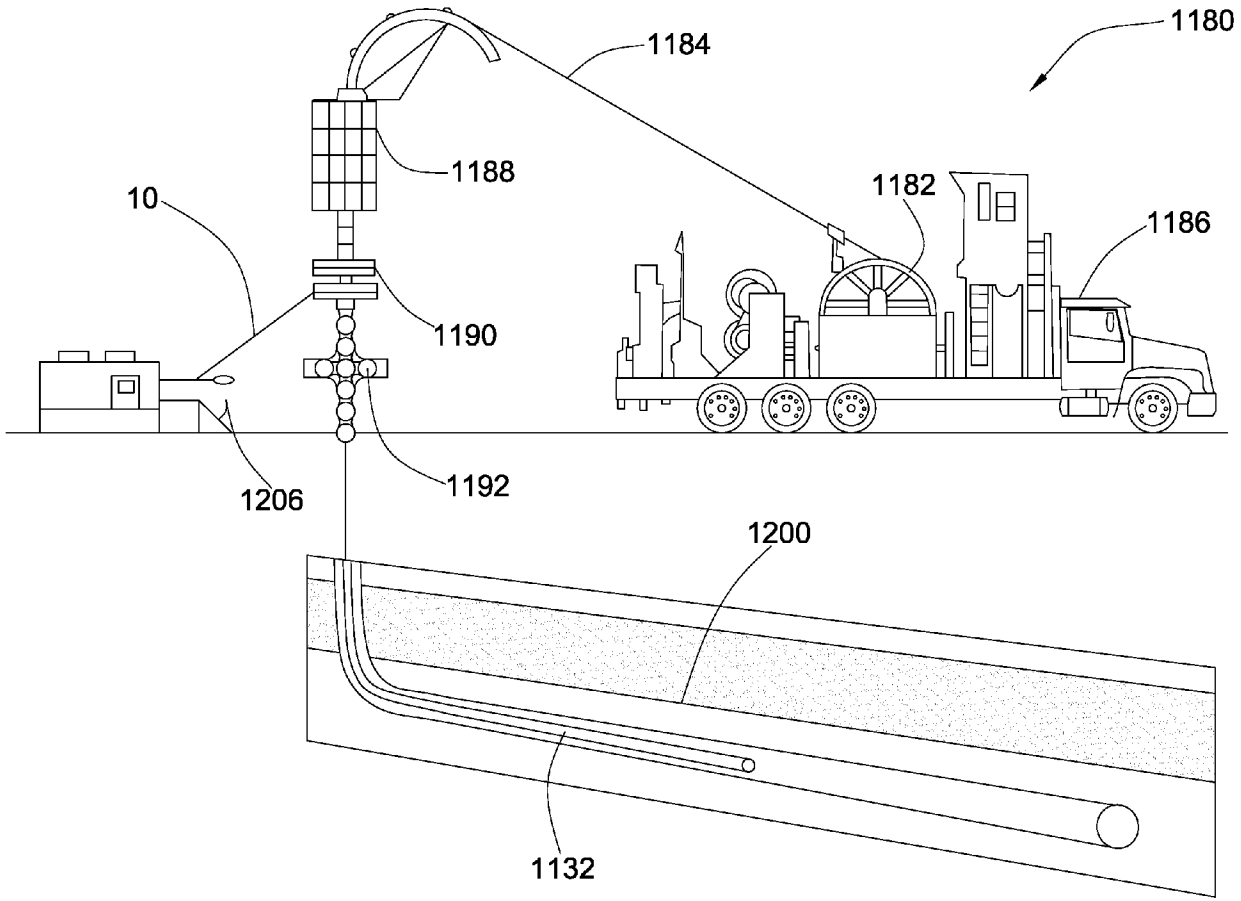
Fig. 1c PRIOR ART

FIG. 1 is a cross-sectional diagram of an embodiment of a tool string 100 suspended in a well bore 101 by a derrick 102. The tool string 100 may comprise a plurality of tool string components 103. One of the downhole tool string components 103 may be a bottom-hole assembly (BHA) 104. The BHA 104 is located at the bottom of the borehole 101 and comprises a drill bit 105. As the drill bit 105 rotates downhole the tool string 100 advances farther into the earth creating a well bore, also known as a borehole. A borehole wall may be a surface of a formation exposed within the borehole. In such an embodiment the tool string 100 is a drill string. As the tool string 100 advances further into the earth additional tool string components 103 may be added to the tool string 100. The tool string 100 may penetrate soft or hard subterranean formations 106. The bottom-hole assembly 104 and/or downhole components may comprise data acquisition devices which may gather data. The data may be sent to the surface via a transmission system to a data swivel 107. The data swivel 107 may send the data to surface equipment. Further, the surface equipment may send data and/or power to downhole tools and/or the bottom-hole assembly 104. U.S. Pat. No. 6,670,880 which is herein incorporated by reference for all that it contains, discloses a telemetry system that may be compatible with the present invention; however, other forms of telemetry may also be compatible such as systems that include mud pulse systems, electromagnetic waves, radio waves, and/or short hop. In some embodiments, no telemetry system is incorporated into the tool string. Mud pulse, short hop, or EM telemetry systems may also be used with the present invention. A mechanical system 110 for forming a liner downhole within well bore 101 comprises a surface rig 108, which may be connected to the derrick 102. A liner 811 is formed downhole in the well bore 101. The liner 811 is formed by spirally winding a continuous strip in a helical pattern as the strip is extruded from a downhole dispenser 601. In the present embodiment the liner 811 is being formed while the tool string is continuing to drill the well bore 101. In some embodiments of the invention the liner 811 is a well casing.

Figure 2:
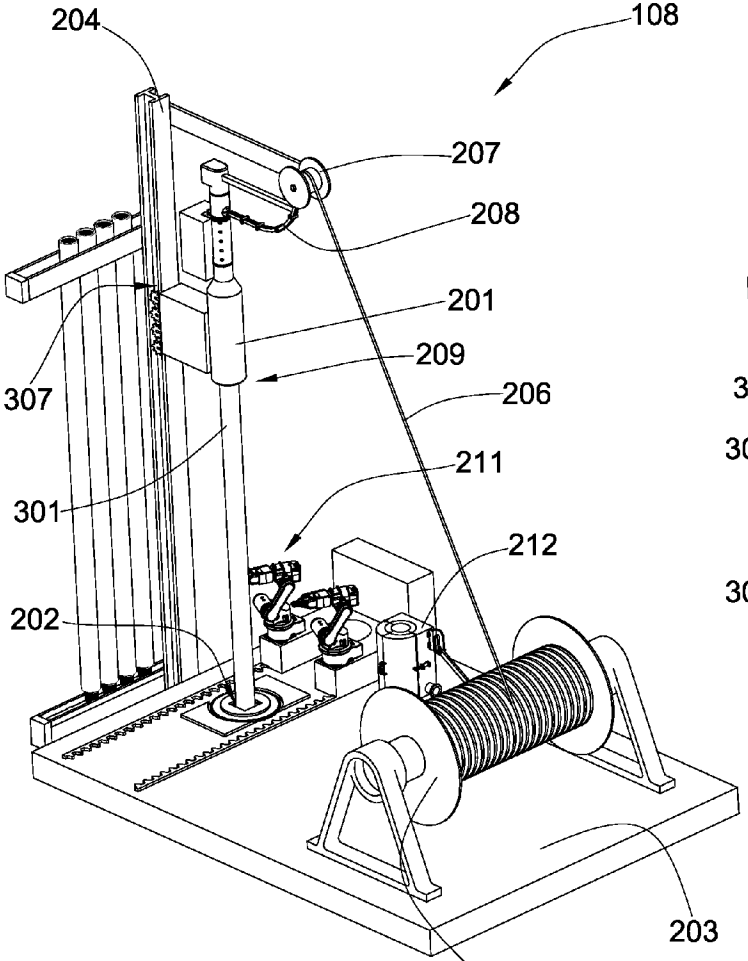
FIG. 2 is a perspective diagram of an embodiment of a surface rig.

Referring to FIG. 2, the surface rig 108 comprises a tool string driving mechanism 201, such as a top hole drive or rotary drive that is connected to the tool string 100. The rig 108 also comprises an aperture 202, such as a mouse hole in a rig platform 203. The aperture 202 is disposed proximate a surface opening of the well bore 101. The driving mechanism 201 may be adapted to rotate axially, and may also be adapted to move vertically along a guide track 204. A spool 205 may also be disposed on the platform 203 and a resilient continuous strip 206 may be wound about the spool 205. The strip 206 may comprise steel, 1095 steel, spring steel, a nickel alloy, aluminum, plastic, polymers, memory alloy metals, or combinations thereof. The strip 206 may extend from the spool 205 around a pulley 207, through an intake guide 208 and into the driving mechanism 201. At least part of the strip 206 may be disposed within the driving mechanism 201. The driving mechanism 201 may be a top drive. The driving mechanism 201 may comprise internal rollers (not shown) that may allow the strip 206 to be retracted into or extended from a lower end 209 of the driving mechanism 201. In the present embodiment the strip 206 extends from the spool 205 into the driving mechanism 201 and thence into a central bore of a first tool string component 301. A pair of robotic arms 211 are disposed on the platform 203 adjacent the aperture 202. A welding enclosure 212 is disposed on the platform 203 adjacent at least one of the robotic arms 211. In some embodiments of the invention only one robotic arm 211 may be disposed on the platform 203, and in other embodiments more than two robotic arms 211 may be used. Other tools and mechanisms may also be disposed on or proximate the platform 203.

Figure 3:
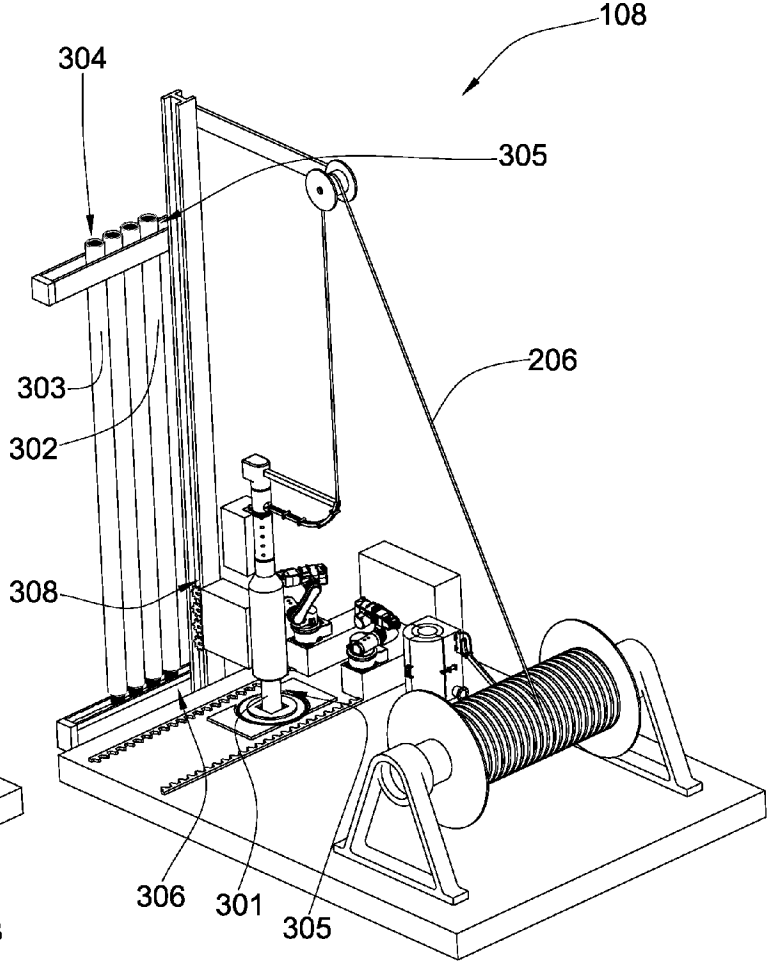
FIG. 3 is a perspective diagram of another embodiment of a surface rig

Referring now to FIG. 3, the rig 108 comprises first and second tool string components 301, 302. Additional tool string components 303 may also be disposed proximate the FIG. 108. Each component 301, 302 comprises a central bore 304 disposed intermediate first and second tool joints 305, 306. In FIGS. 2 and 3 the first tool joint 305 of the first component 301 is mechanically coupled to the driving mechanism 201 and the second tool joint 306 of the first component 301 is connected to the tool string 100. As drilling progresses from FIG. 2 to FIG. 3, the driving mechanism 201 moves from a top position 307 to a bottom position 308 until the first component's first tool joint 305 is proximate the aperture 202.

Figure 4:
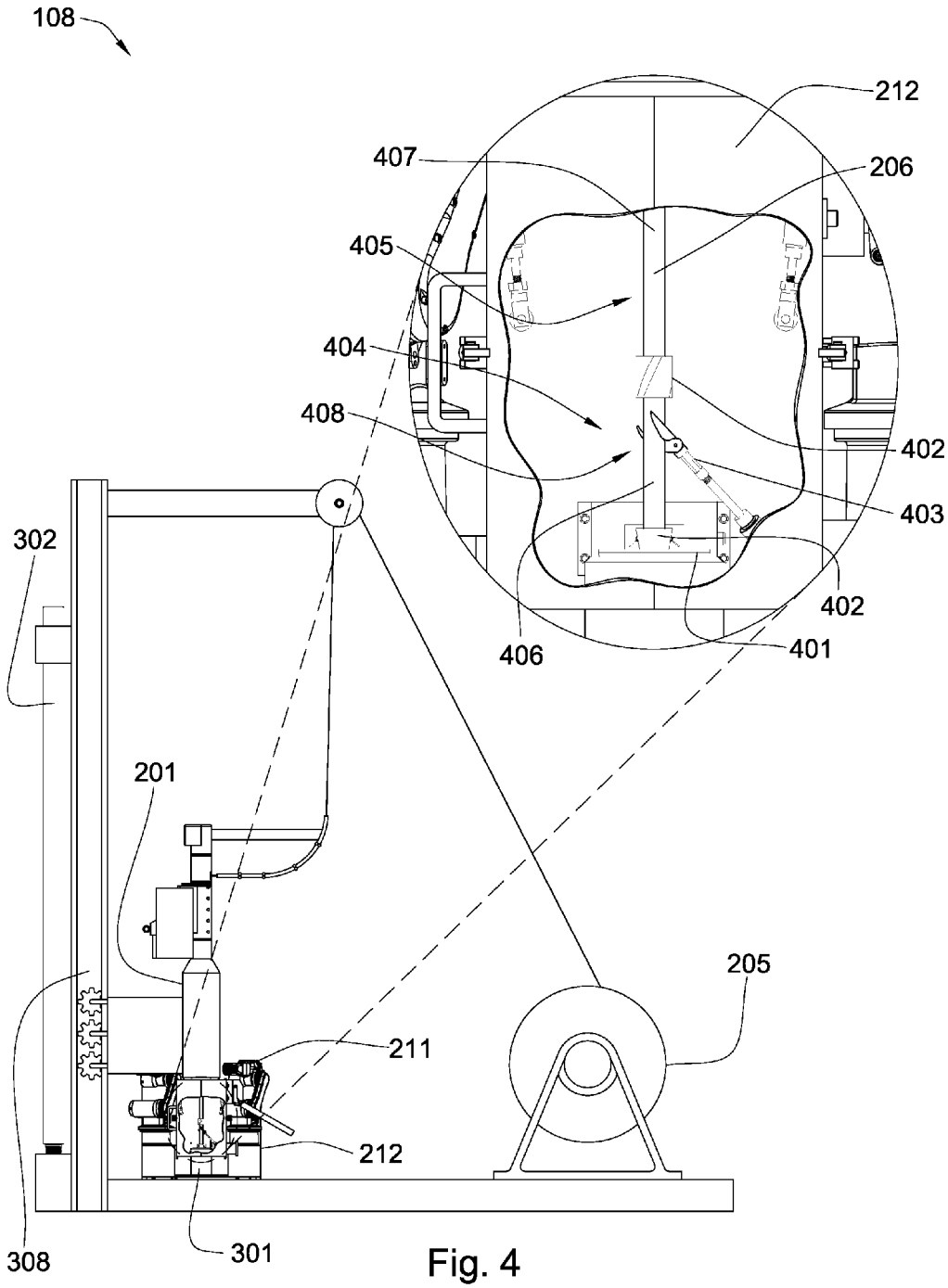
FIG. 4 is an orthogonal diagram of an embodiment of a lining material cutter mechanism disposed on an embodiment of a surface rig.

Referring to FIG. 4, the first component 301 has had its first tool joint 305 decoupled from the driving mechanism 201. The continuous strip 206 still extends continuously from the spool 205 through the central bore 304 of the first component 301 via the driving mechanism 201. The welding enclosure 212 is now disposed proximate the aperture 202 and between the first component 301 and the driving mechanism 201. The robotic arms 211 may have positioned the enclosure 212 adjacent the aperture 202. A cap 401 is disposed on the first tool joint 305 of the first component 301. Together with retention devices 402, the cap 401 holds the strip 206 in a specific orientation and prevents the strip from moving further into the first and second components 301, 302, or into the driving mechanism 201. A strip cutting mechanism 403 is disposed within the enclosure 212 and is disconnecting a first portion 404 of the strip 206 from a second portion 405 of the strip 206. Although in FIG. 4 the strip cutting mechanism 403 is a sheer cutter, the first and second portions 404, 405 may be detached from one another by cutting, snipping, crimping, sawing, bending, heating, unhooking, using a water jet cutter, using a sheer cutter, or combinations thereof. In some embodiments of the invention the strip cutting mechanism 403 may not be disposed within the enclosure 212. Once the first and second portions 404, 405 are detached from one another, the retention devices 402 continue to prevent the portions 404, 405 from retracting respectively into the first component 301 and the driving mechanism 201. Once detached from one another the first portion 404 is a first resilient strip 406 and the second portion 405 is a second resilient strip 407. A first end 408 of the first strip 406 is retained by the retention device 402 and cap 401 and is disposed within the bore 304 of the first component 301.

Figure 5:
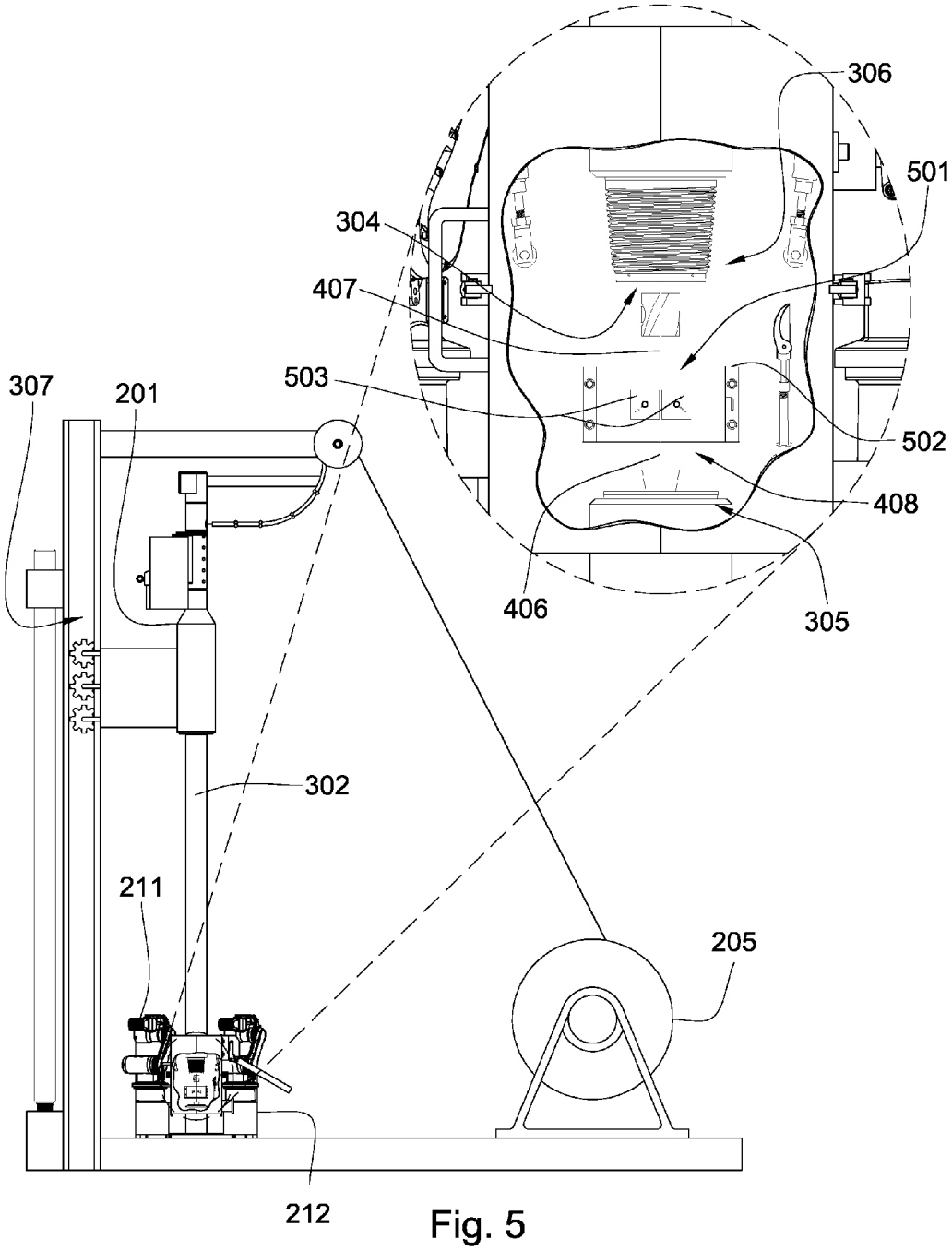
FIG. 5 is an orthogonal diagram of an embodiment of a lining material connecting mechanism disposed on an embodiment of a surface rig.

Referring now to FIG. 5, the driving mechanism 201 has returned to the top position 307. The first tool joint 305 of the second tool string component 302 is mechanically coupled to the driving mechanism 201 and the second strip 407 is disposed in the bore 304 of the second component 302. The second component's first tool joint 305 may have been positioned proximate the driving mechanism 201 by one or more of the robotic arms 212. In some embodiments of the invention another placement mechanism (not shown) may position the second component 302. The second strip 407 now extends from the spool 205 to the second tool joint 306 of the second component 302 via the driving mechanism 201. A second end 501 of the second strip 407 extends out from the second tool joint 306 of the second component 302. The second strip's second end 501 may have passed through the central bore 304 of the second component 302 from the first tool joint 305 to the second tool joint 306. Part of the second strip 407 may have been retracted within the driving mechanism 201 in order to pass the second strip 407 through the second component 302. The second component's second tool joint 306 is disposed proximate the first component's first tool joint 305 and the aperture 202. A strip connecting mechanism 502 is disposed within the enclosure 212 proximate the ends 408, 501 of the first and second strips 406, 407.

In FIG. 5 the strip connecting mechanism 502 is a band saw welder. Connecting mechanism 502 comprises two electrodes 503 that are disposed on each side of the first and second strips 406, 407. By generating a power transfer between the electrodes 503 via the first and second strips 406, 407 the strips may be welded together to form a continuous resilient strip 206. The continuous strip 206 may be disposed within the bores 304 of both the first and second components 301, 302 and within the driving mechanism 201. Other means of connection and other types of connecting mechanisms 502 may be compatible with the invention. In some embodiments the first and second strips 406, 407 may be connected by a lap joint, butt joint, interlocking joint, or combinations thereof. A connection between strips 406, 407 may comprise a weld, crimp, indent, hook, or combinations thereof.

It is believed that welding of the first and second strips 406, 407 is effective in an inert environment. In some embodiments of the invention the enclosure 212 may create an inert internal environment. The internal environment may be created by pumping argon gas into the enclosure 212. In some embodiments of the invention the cutting mechanism 403 and the connecting mechanism 502 may not both be disposed in the enclosure 212. Some embodiments of the invention may not comprise a cutting mechanism 403. In such embodiments a plurality of first and second tool string components 301, 302 may each comprise a first or second strip 406, 407 disposed within its bore 304 when the components 301, 302 are added to the tool string 100. In some such embodiments at least one tool component 301, 302 may comprise a length of strip 406, 407, 206 that is longer than that component's length. In some embodiments the strip's length may be at least 8 times the component's length.

With strips 406, 406 connected to form continuous strip 206, the second component's second end 306 may be mechanically coupled to the first component's first end 305 and the second component 302 may be lowered into the well bore 101. The continuous strip 206 may extend from within the driving mechanism 201 and through the bores 304 of both the first and second components 301, 302. Once the second component's first end 305 is proximate the aperture 202 the second component 302 may be treated as a first component 301, and an additional second component 302 may be added to the tool string. This process may allow for the continual addition of tool string components 103 while passing a continuous strip 206 through the bores 304 of tool string components 103.

Figure 6:
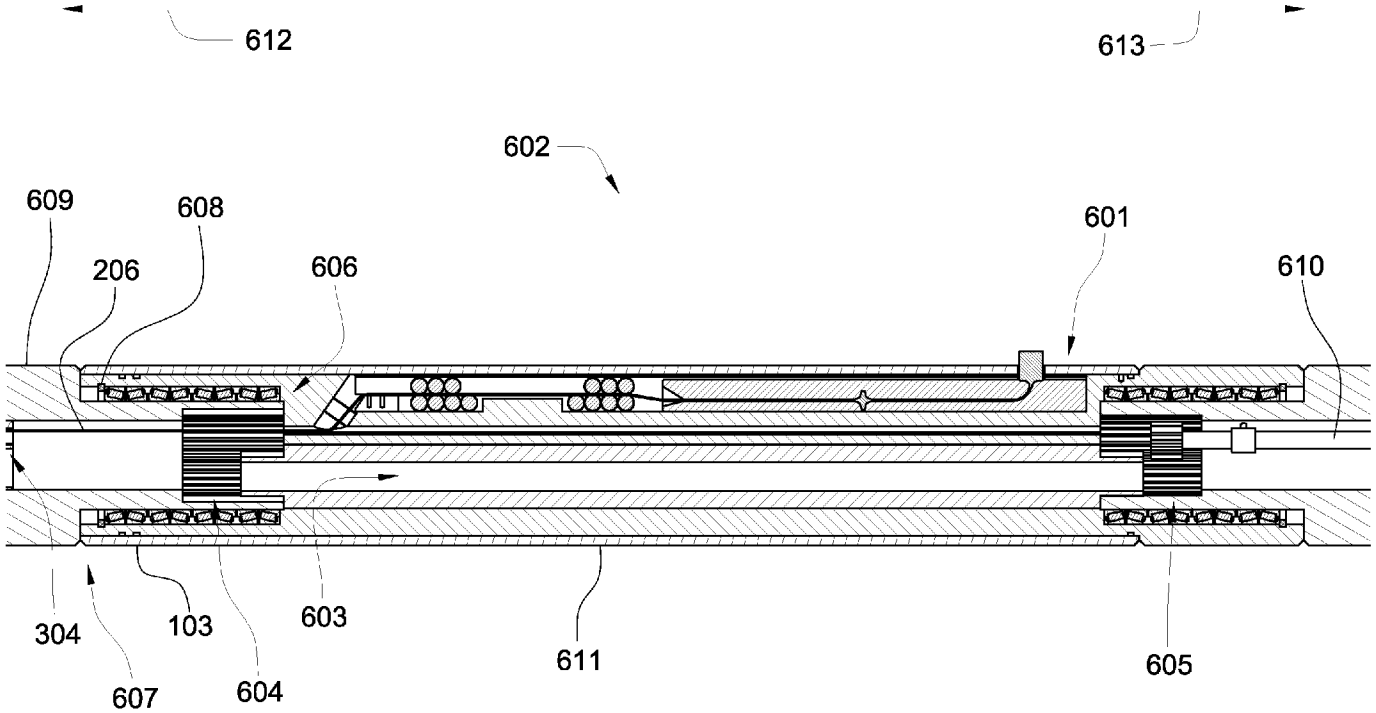
FIG. 6 is a cross-sectional diagram of an embodiment of a downhole dispenser disposed within a downhole tool component.

Referring to FIG. 6, system 110 also comprises at least one downhole dispenser 601 that is adapted to direct the resilient continuous strip 206 against the well bore 101 to form a liner. The dispenser 601 is disposed within at least one downhole tool string component 103. The continuous strip 206 may extend from the driving mechanism 201 to the dispenser 601. In FIG. 6 the dispenser is part of a winding tool 602. Winding tool 602 comprises a sleeve 611 that substantially excludes drilling mud from the dispenser 601. The winding tool 602 also comprises a central bore 603 that connects the central bores 304 of tool string components 103 downhole from the tool 602 with those above tool 602. Central bore 603 comprises upper and lower splines 604, 605 that cause it to rotate axially with the tool string 100. In some embodiments of the invention the winding tool 602 may rotate axially independent of the tool string 100. A bearing stack 606 may be disposed proximate a component junction 607 and may facilitate the axial rotation of the winding tool 602 with respect to the rest of the tool string 100. The bearing stack 606 may also facilitate engagement and disengagement of the winding tool 602 with the rest of the tool string 100. A lock ring 608 may be disposed proximate the component junction 607. The lock ring 608 may facilitate engagement and disengagement of the winding tool 602 and an adjacent tool string component 609.

Figure 7:
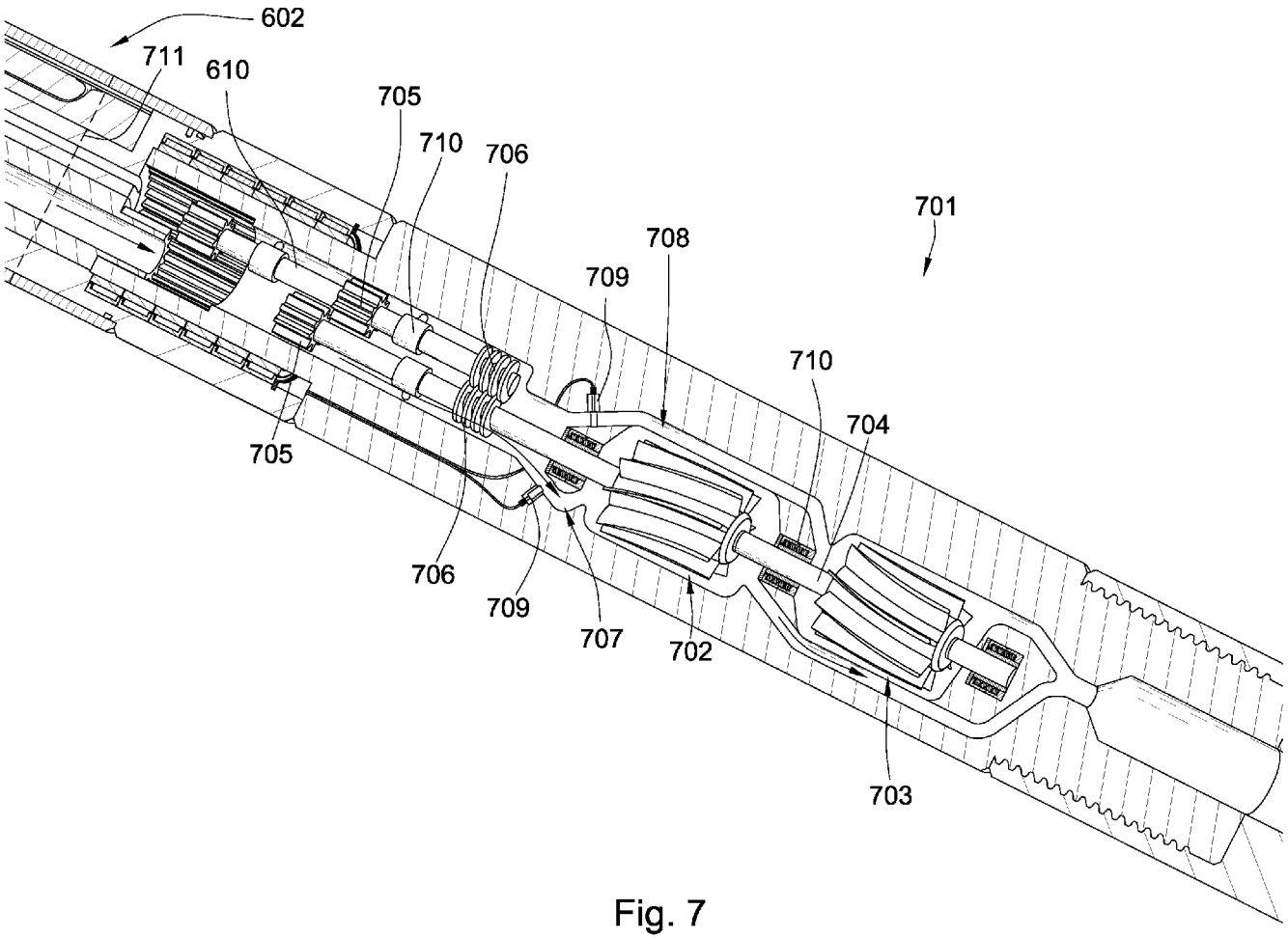
FIG. 7 is a perspective cross-sectional diagram of an embodiment of a downhole mud motor.

Referring now to FIGS. 6 and 7, the winding tool 602 and the dispenser 601 may rotate axially and both their axial rotation may be powered by rotation of the tool string 100. Such rotation may be caused by the driving mechanism 201. In some embodiments of the invention dispenser rotation may be powered by a downhole mud motor 701. In such embodiments the winding tool 602 may be disengaged from the adjacent component 609 by pulling adjacent component 609 in the direction of upward arrow 612 through the tool string 100. The lock ring 608 may be a split ring. The lock ring 608 may be pulled radially inward toward a central axis of the lock ring 608 by the upward pull 612, thereby allowing the adjacent component 609 to translate vertically away from the winding tool 602 in the direction of upward arrow 612. In such embodiments the lock ring 608 may have a secondary lock position which stops vertical translation of the adjacent component 609 before it is completely disengaged from the winding tool 602. In such embodiments the bearing stack 606 may allow the winding tool 602 to rotate axially with respect to adjacent component 609. Bearing stack 606 may comprise angled contact bearings, needle roller bearings, ball bearing, or combinations thereof. With winding tool 602 free to rotate axially with respect to component 609 it may then be rotationally engaged to the mud motor 701. Winding tool 602 may comprise an input shaft 610. Input shaft 610 may rotate axially powered by the mud motor 701. The input shaft 610 may also translate into and out of contact with lower spline 605. When input shaft 610 is in contact with lower spline 605, the winding tool 602 rotates axially powered by the mud motor 701 via the input shaft 610.

Figure 8:
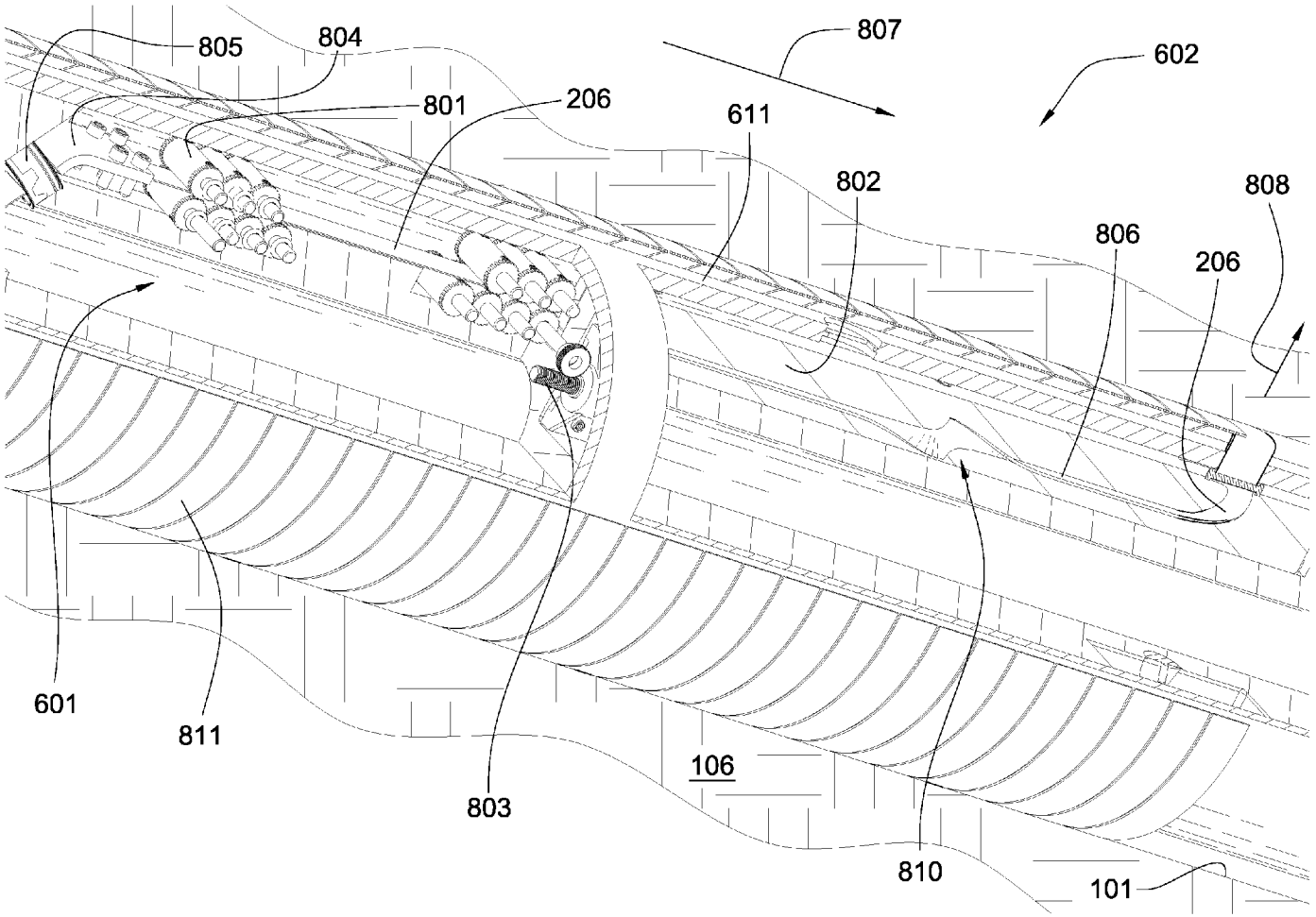
FIG. 8 is a cross-sectional diagram of an embodiment of a winding tool disposed within a downhole tool string.

FIG. 7 discloses an embodiment of a mud motor 701 that can power input shaft 610 and winding tool 602. Mud motor 701 comprises a first turbine 702 and a second turbine 703 connected by central shaft 704. Central shaft 704 is threadingly connected with input shaft 610. Central shaft 704 and input shaft 610 each comprise a spline 705 and a screwthread 706. Splines 705 are adapted to allow the transfer of axial rotation from central shaft 704 to input shaft 610. Screwthread 706 is adapted to transfer the axial rotation of the central shaft 704 to a translation of the input shaft 610 into and out of contact with lower spline 605. Screwthread 706 is also adapted to translate splines 705 into and out of contact with one another. Mud motor 701 comprises a first mud flow path 707 and a second mud flow path 708. In the present embodiment a plurality of arrows indicates the passage of mud through the tool string and through the first mud flow path 707. The first flow path 707 allows drilling mud (not shown) to pass by the first turbine 702 and causes central shaft 704 to rotate axially in a first direction. The second flow path 708 allows drilling mud to pass by the second turbine 703 and causes central shaft 704 to rotate axially in a second direction opposite the first direction. Drilling mud enters the mud motor 701 through the central bores 304, 603 of the tool string components 103 and the winding tool 602. Flow control valves 709 may open and close to direct the mud flow into either the first or second pathway 707, 708. Mud motor 701 also comprises a plurality of bearing assemblies 710. Each bearing assembly 710 is adapted to axially support either the central shaft 704 or the input shaft 610 while facilitating low-friction axial rotation. In embodiments of the invention where rotation of the first turbine 702 causes the input shaft 610 to engage with and rotate the lower spline 605, rotation of the second turbine 703 may cause the input shaft 610 to disengage from the lower spline 605. Once mud motor 701 is disengaged from winding tool 602, adjacent component 609 may be engaged with winding tool 602 by exerting a downward force 613 on the tool string 100. Winding tool 602 may comprise an outer diameter 711, Referring now to FIG. 8, dispenser 601 comprises a plurality of strip rollers 801 and a guide block 802. The plurality of strip rollers 801 may pull the continuous strip 206 into and through the dispenser 601. Rollers 801 may be powered by the rotation of a connection spline 803. Connection spline 803 may rotate axially as a result of tool string rotation or as a result of a downhole motor. Downhole motors may include mud motors, electric motors, or combinations thereof. One or more deflection plates 804 may guide the strip 206 from the central bore 304 of adjacent component 609 into the dispenser 601 and into the rollers 801. The strip 206 may pass through a pressure actuated seal 805 as it enters the dispenser 601 in order to isolate the dispenser 601 from the pressure and drilling mud in the central bore 304. The rollers 801 may feed the strip 206 into guide block 802. Guide block 802 comprises an inner slot 806 adapted to receive the strip 206 and change the direction of the strip 206. In FIG. 8 strip 206 comprises a first flow direction 807 when the strip 206 enters the guide block 802. As the strip 206 passes through guide block 802 strip 206 acquires a second flow direction 808. In some embodiments of the invention the guide block 802 may cause the second flow direction 808 to differ from the first flow direction 807 by a rotation of between 65 and 115 degrees. Guide block 802 may be disposed within outer diameter 711 of winding tool 602. In FIG. 8 inner slot 806 comprises a twist 810 adapted to facilitate the change in flow directions in the guide block 802. As dispenser 601 directs strip 206 against the well bore 101, strip 206 forms liner 811. Liner 811 may be formed in the direction of drilling and may be formed simultaneously while drilling. In some embodiments of the invention the liner 811 may comprise a continuous length along the well bore 101 of at least 40 feet.

Figure 9:
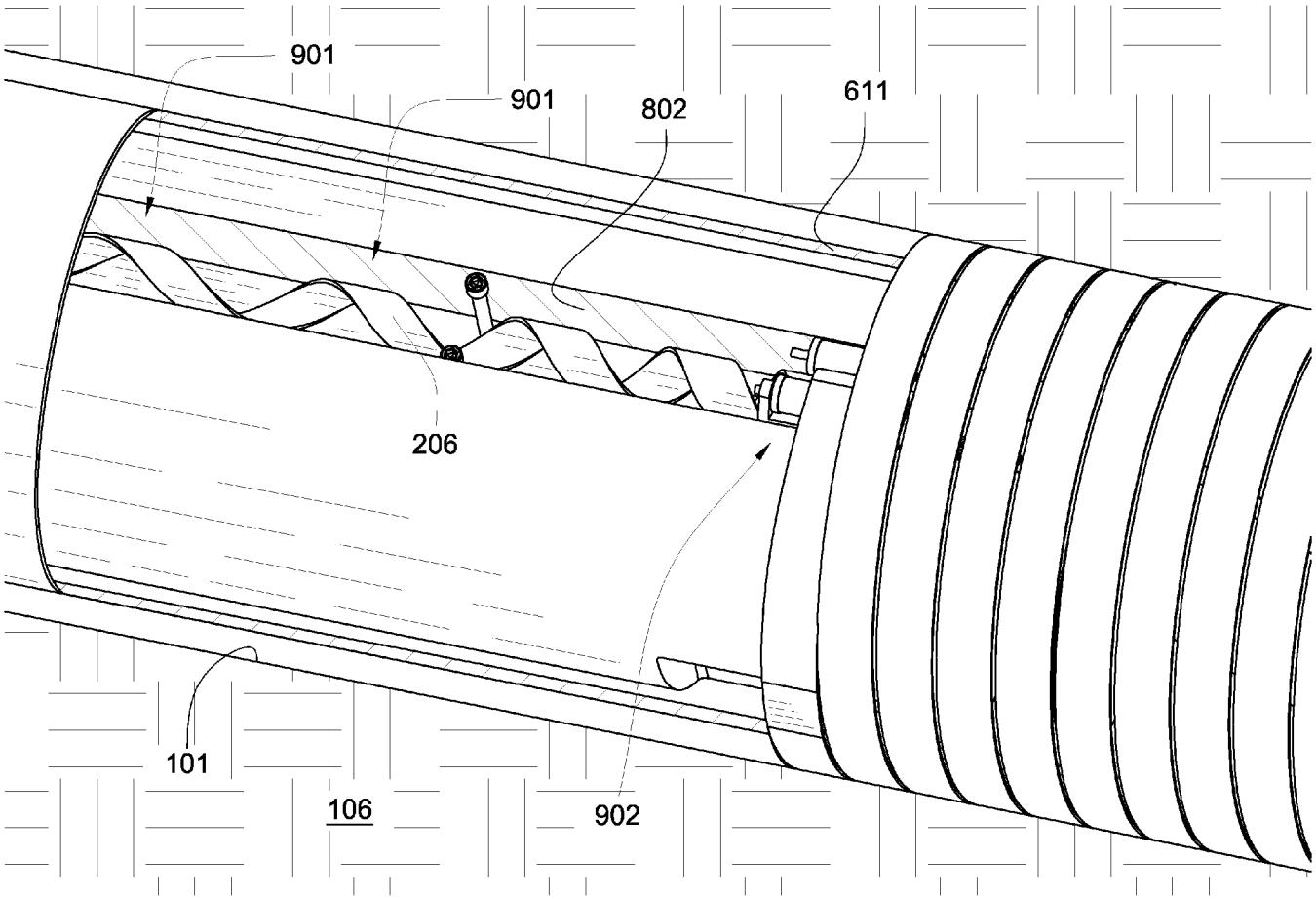
FIG. 9 is a cross-sectional diagram of an embodiment of a guide block disposed within a downhole dispenser.

FIG. 9 discloses an embodiment of the invention in which guide block 802 comprises a plurality of twists 901 adapted to facilitate changes in flow direction of the strip 206 in the guide block 802. FIG. 9 also discloses the use of tension control rollers 902. Tension control rollers 902 may be disposed proximate an outlet of the sleeve 611 and may help to force the strip 206 outward into contact with the well bore 101. In some embodiments of the invention tension control rollers 902 may be adjustable in order to vary tension on the strip 206.

Figure 10:
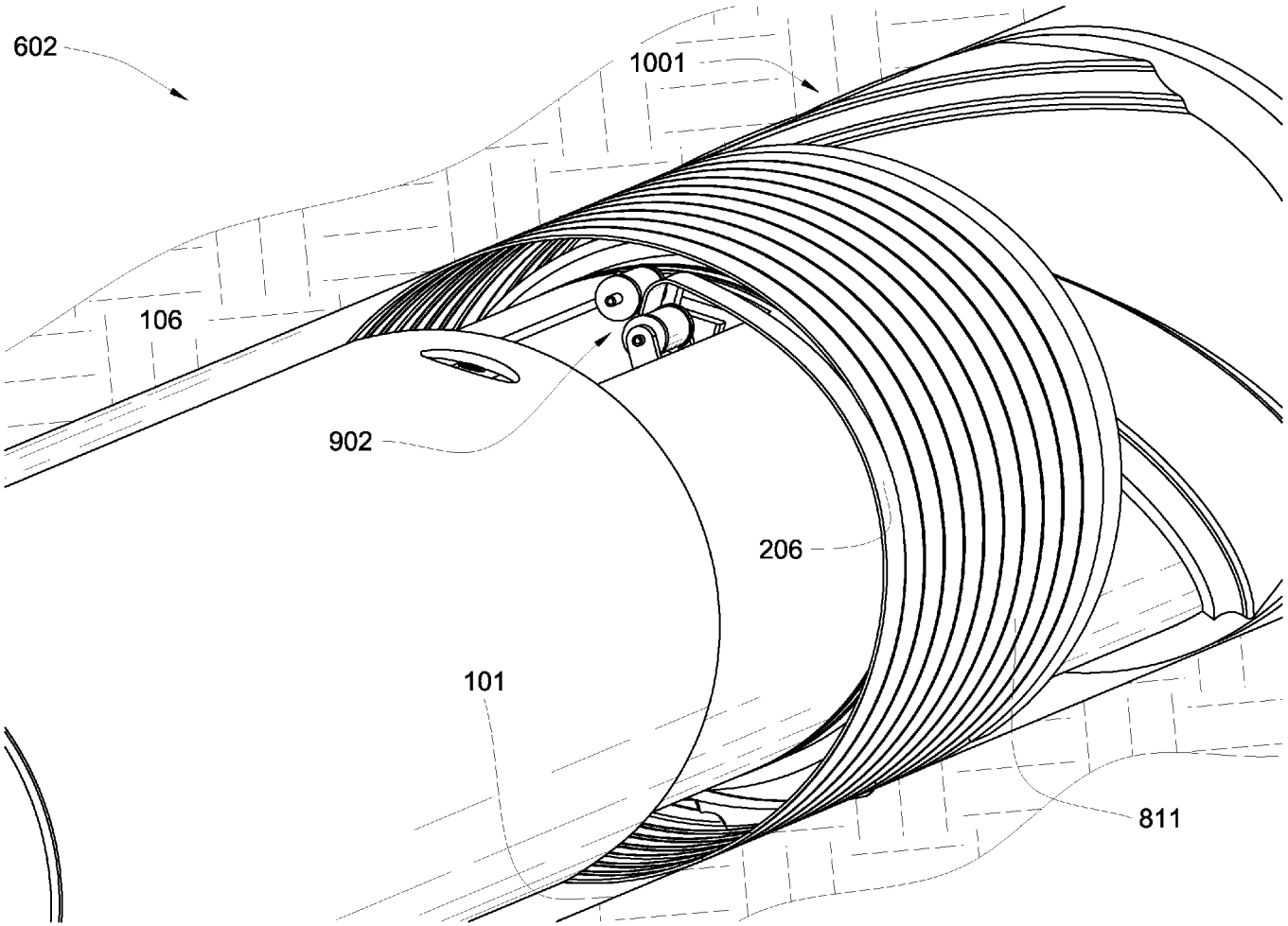
FIG. 10 is a perspective diagram of a dispenser in the process of dispensing lining materials to form a liner.

FIG. 10 offers another view of tension control rollers 902 directing strip 206 outward into contact with the well bore 101. FIG. 10 discloses a reamer 1001 disposed downhole from the winding tool 602. FIG. 10 also discloses an embodiment of the invention in which liner 811 is formed while the tool string 100 is being withdrawn from the well bore 101. In some embodiments of the invention the winding tool 602 may case or line a well while being inserted into the well bore 101, and then again while being removed from the well bore 101. In some embodiments of the invention the winding tool 602 may wind the liner 811 in one direction while inserting in to the well and in another direction while being removed.

Figure 11:
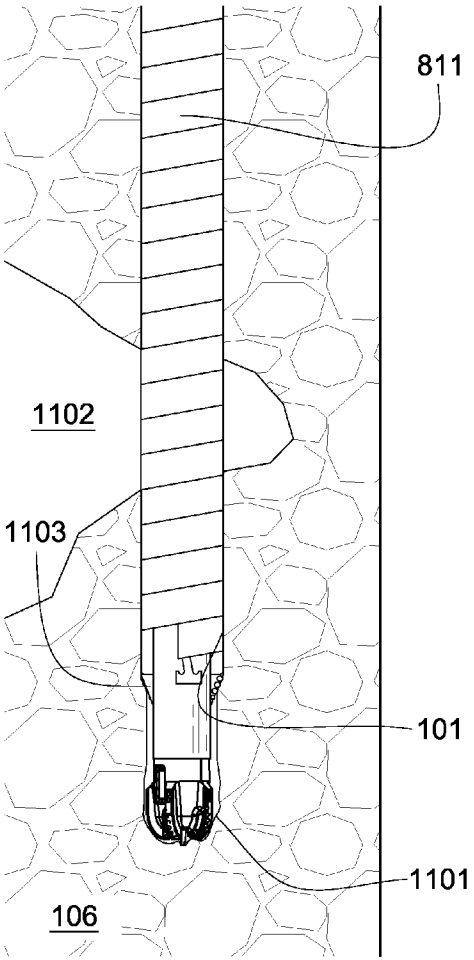
FIG. 11 is an orthogonal diagram of an embodiment of a tool string disposed within a cross-section of a bore hole.

Referring now to FIG. 11, a casing-while-drilling operation forms a liner 811 against a well bore 101 while drill bit 1101 is drilling the well bore 101 deeper into the formation 106. FIG. 11 also discloses an embodiment of the invention in which the liner 811 isolates the well bore 101 from a downhole cavity 1102. A reamer 1103 comprises retractable blades and widens the bore before the strip is applied to the bore wall so that although the casing narrows the diameter of the well bore, the diameter will remain large enough to accommodate the removal of the drill bit 1101.

Figure 12:
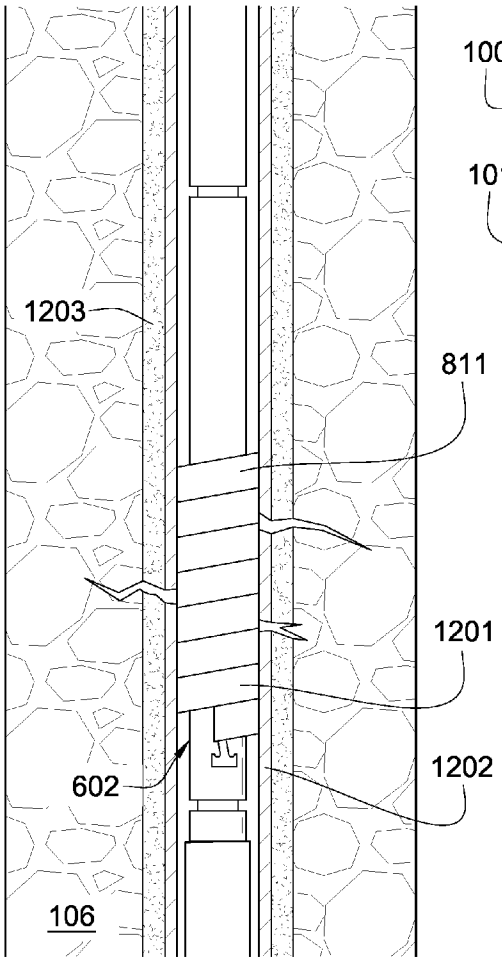
FIG. 12 is an orthogonal diagram of another embodiment of a tool string disposed within a cross-section of a bore hole.

FIG. 12 discloses an embodiment of the invention in which system 110 forms a liner 811 that is a patch 1201 for a well casing 1202. A concrete filler 1203 is disposed between the well bore 101 and the well casing 1202. In such embodiments the system 110 may operate separate from the drilling process. In some embodiments of the invention the liner 811 may be a well-casing, a path, a liner, or combinations thereof.

Figure 13:
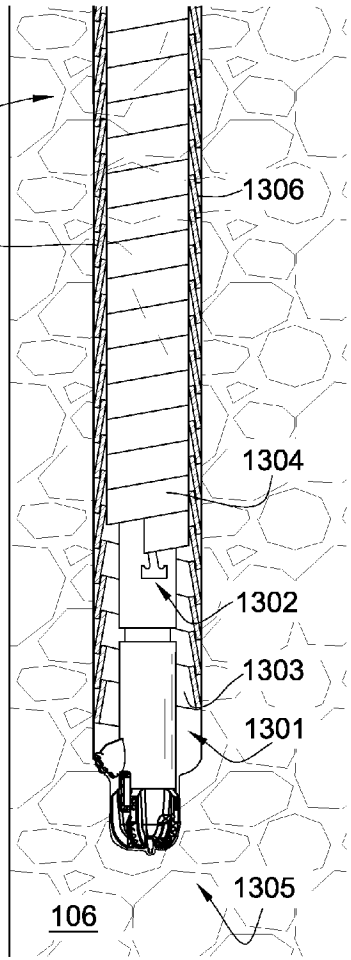
FIG. 13 is an orthogonal diagram of another embodiment of a tool string disposed within a cross-section of a bore hole.

Referring now to FIG. 13, an embodiment of the invention is disclosed in which a single tool string 100 comprises a plurality of winding tools 602. In FIG. 13 the tool string 100 comprises a first winding tool 1301 and a second winding tool 1302. The first winding tool 1301 may form a first liner 1303 wound in a direction opposite the winding direction of second liner 1304 formed by the second winding tool 1302. In such embodiments the first winding tool 1301 and a drill bit 1305 may rotate axially powered by a downhole mud motor while the second winding tool 1302 rotates axially powered by rotation of the tool string 100. In some embodiments the first and second winding tools 1301, 1302 may wind in the same direction or in the general direction FIG. 13 also discloses a liner 1303 with substantially planar segments 1306 where adjacent segments 1306 do not interlock. In such embodiments a forming tool (not shown) may exert an outward pressure on the segments 1306 during or shortly after the segments 1306 contact the well bore 101. This practice may help to maintain a consistent liner diameter along the well bore 101. A bi-center bit 1305 may be used to accommodate the removal of the bit, even though the casing narrows the diameter of the bore hole.

Figure 14:
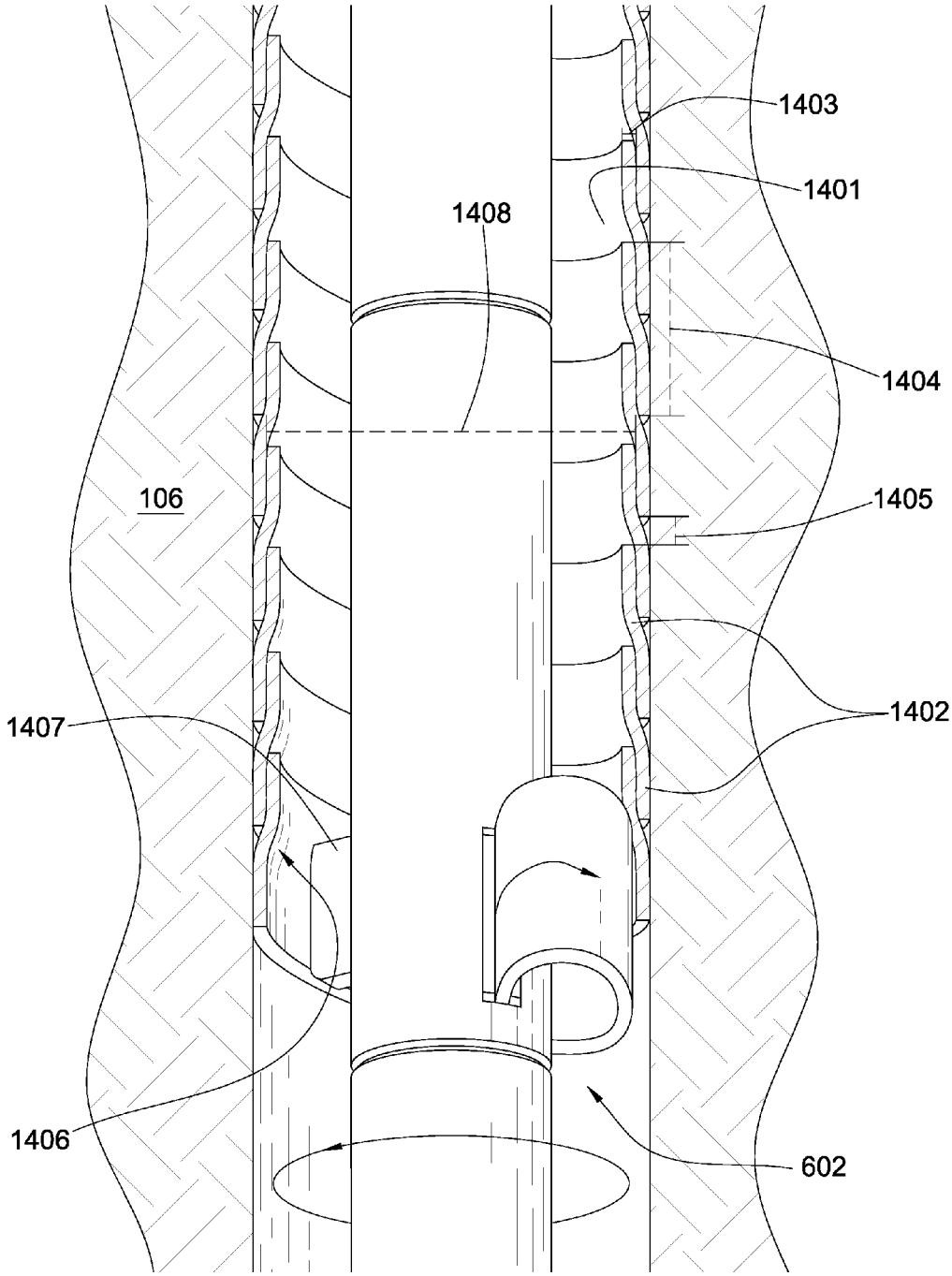
FIG. 14 is a cross-sectional embodiment of a liner disposed within a well bore.

FIG. 14 is a cross-sectional diagram of a formation 106 and liner 1401 while the liner 1401 is being formed by a winding tool 602. Liner 1401 comprises a plurality of overlapping spiral segments 1402. Each segment 1402 constitutes a portion of continuous strip 206. Strip 206 may comprise a strip thickness 1403 of between 0.008 and 0.25 inches. Strip 206 may comprise a total strip width 1404 and a dent width 1405. The dent width 1405 may be at least one fifth the amount of the total strip width 1404. The dent width 1405 may be a characteristic of a strip dent 1406 caused in spiral segments 1402 by a deforming member 1407 connected to the winding tool 602. Various shapes, orientations and placements of deforming members 1407 may be consistent with the present invention. Strip deformations 1406 may allow for liner 1401 to maintain a consistent overall diameter 1408 along an entire length of the liner 1401.

Figure 15:
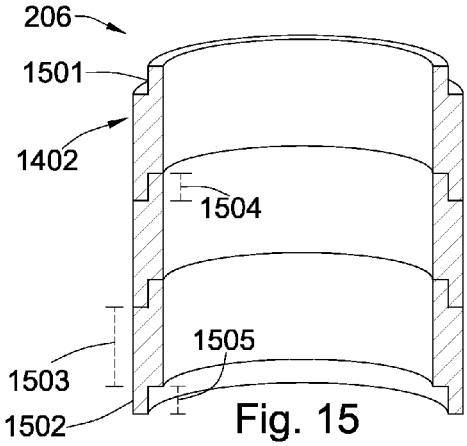
FIG. 15 is a cross-sectional diagram of an embodiment of a liner.

FIGS. 15-20 disclose different geometries of strips 206 shown in overlapping spiral segments 1402 as part of a liner 811. FIG. 15 discloses a strip 206 comprising first and second step portions 1501, 1502. The first portion 1501 of one segment 1402 of the strip 206 may interlock with a second portion 1502 of an adjacent segment 1402 of the same strip 206. First and second portions 1501, 1502 may respectively comprise first and second heights 1504, 1505. In some embodiments of the invention a central height 1503 of segments 1402 may be no more than one half the value of both heights 1504, 1505.

Figure 16:
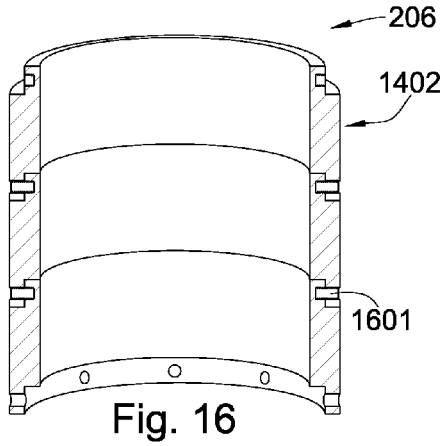
FIG. 16 is a cross-sectional diagram of another embodiment of a liner.
Figure 17:
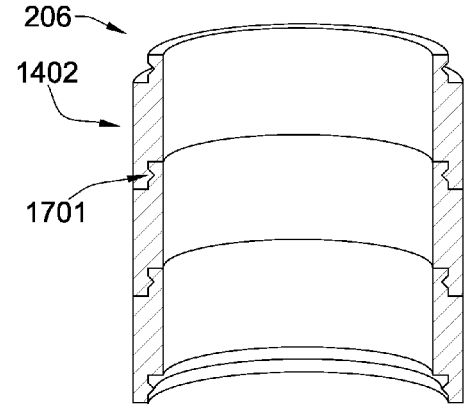
FIG. 17 is a cross-sectional diagram of another embodiment of a liner.
Figure 18:
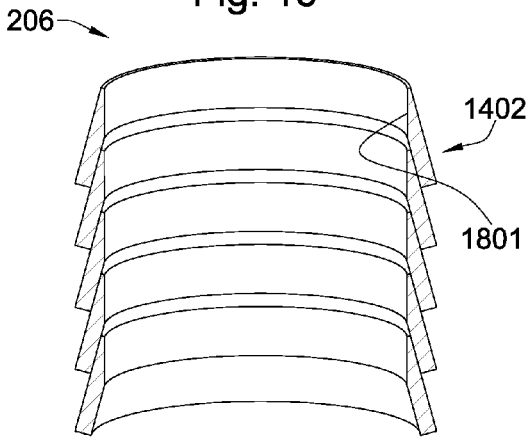
FIG. 18 is a cross-sectional diagram of another embodiment of a liner.
Figure 19:
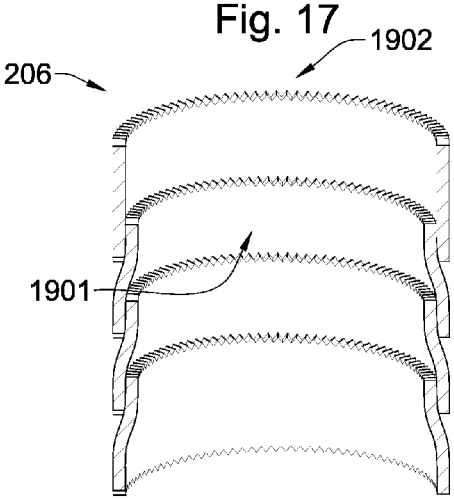
FIG. 19 is a cross-sectional diagram of another embodiment of a liner.
Figure 20:
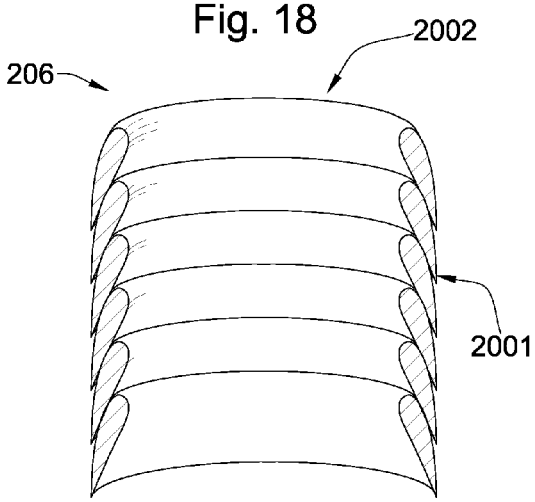
FIG. 20 is a cross-sectional diagram of another embodiment of a liner.

FIG. 16 discloses adjacent overlapping spiral segments 1402 connected by a plurality of bolts 1601. FIG. 17 discloses adjacent segments 1402 that interlock with one another using an interlocking snap intersection 1701. FIG. 18 discloses segments 1402 that each comprise flatted end 1801. FIG. 19 discloses ridged segments 1901 comprising longitudinal edge 1902. Longitudinal edge 1902 of strip 206 may comprise a ridged geometry as disclosed in FIG. 19, or other ridged geometries. Rollers 801 may be disposed adjacent longitudinal edges 1902 of strip 206 in a winding tool 602. Rollers 801 may comprise a complementary geometry to the ridged geometry of the strip's longitudinal edge 1902 and may thereby facilitate translation of the strip 206 through the bores 204 of the tool string components 103 and into the dispenser 601. FIG. 20 discloses segments 1402 comprising a thin side 2001 and a thick side 2002. This is believed to facilitate elongation of the liner 811 without decreasing the diameter of the liner 811.

Figure 20C:
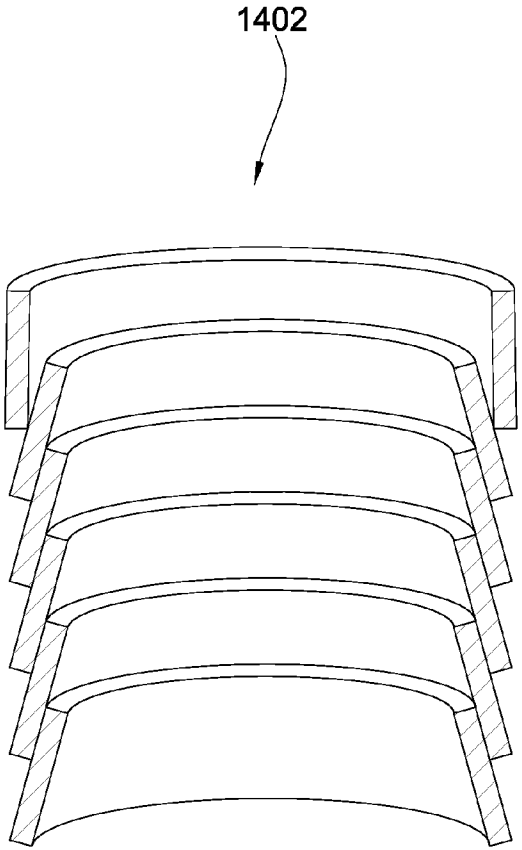
FIG. 20*c* is a cross-sectional diagram of another embodiment of a liner.
Figure 20B:
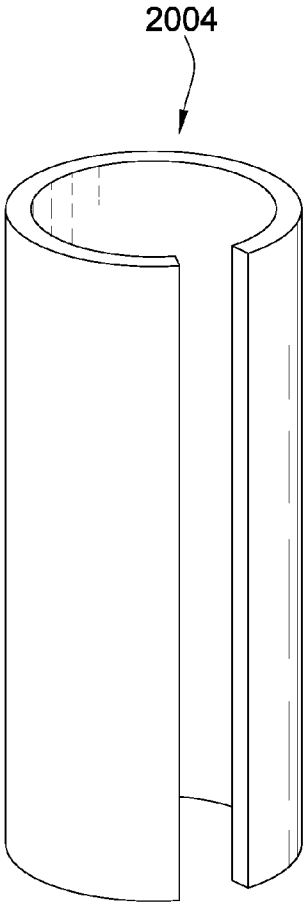
FIG. 20*b* is a cross-sectional diagram of another embodiment of a lining material.
Figure 20A:
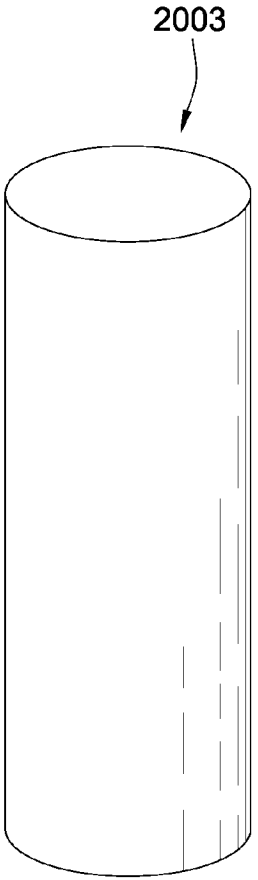
FIG. 20*a* is a cross-sectional diagram of another embodiment of a lining material.

Referring now to FIG. 20*a*, an embodiment is disclosed in which a lining material 2003 is a solid and comprises a generally cylindrical geometry. The lining material 2003 may be a long, continuous cylindrical wire. In some embodiments of the invention a forming device disposed downhole may shape or mash the lining material 2033 into a generally flat strip 206.

FIG. 20*b* discloses a lining material 2003 that is a split tube 2004. The split tube 2004 may be an advantageous geometry for conveying lining material 2003 downhole. Once downhole a forming device may unwrap the split tube 2004 to form a generally flat strip 205.

FIG. 20*c* discloses another embodiment of a liner 1402 flexible enough to bend around the adjacent segments.

Figure 21:
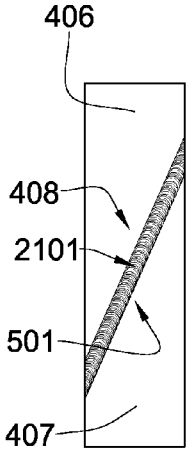
FIG. 21 is an orthogonal diagram of an embodiment of a connection between first and second lining materials.
Figure 22:
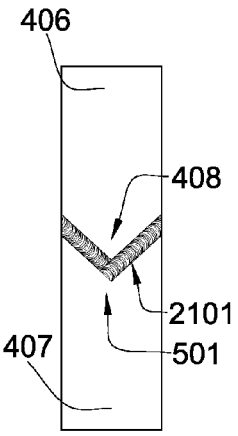
FIG. 22 is an orthogonal diagram of another embodiment of a connection between first and second lining materials.
Figure 23:
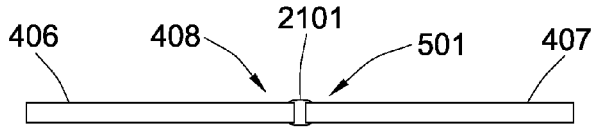
FIG. 23 is an orthogonal diagram of another embodiment of a connection between first and second lining materials.
Figure 24:
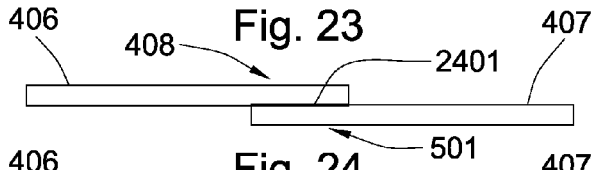
FIG. 24 is an orthogonal diagram of another embodiment of a connection between first and second lining materials.
Figure 25:
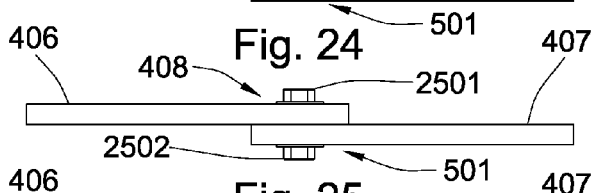
FIG. 25 is an orthogonal diagram of another embodiment of a connection between first and second lining materials.
Figure 26:
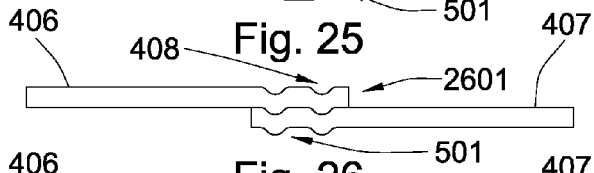
FIG. 26 is an orthogonal diagram of another embodiment of a connection between first and second lining materials.
Figure 27:
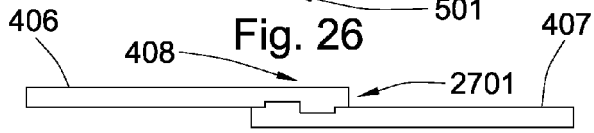
FIG. 27 is an orthogonal diagram of another embodiment of a connection between first and second lining materials.
Figure 28:
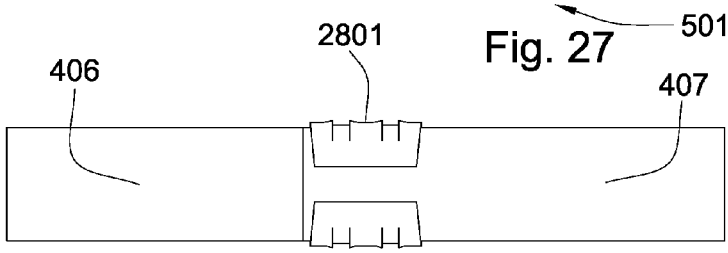
FIG. 28 is an orthogonal diagram of another embodiment of a connection between first and second lining materials.

FIGS. 21-28 show various embodiments of first ends 408 of first strips 406 connected to second ends 501 of second strips 407. FIGS. 21-23 disclose a welded connection 2101. Other embodiments of welded connections 2101 may be compatible with the present invention. In some embodiments overlapping first and second ends 408, 501 may be welded together. FIGS. 24-28 disclose overlapping connections. FIG. 24 discloses the use of a high strength adhesive 2401 to connect the first and second strips 406, 407. FIG. 25 discloses using of a bolt 2501 and a nut 2502 to connect the first and second strips 406, 407. FIG. 26 discloses an embodiment of the invention in which the first and second strips 406, 407 comprise a crimped connection 2601. FIG. 27 discloses an embodiment of an interlocking connection 2701. In FIG. 28 a jacket 2801 is crimped around an overlapping connection.

Figure 29:
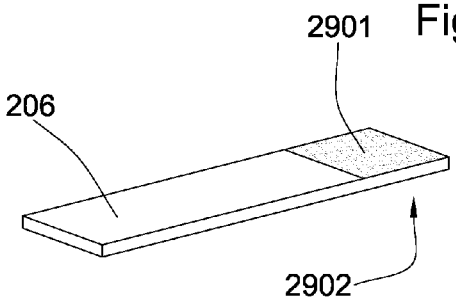
FIG. 29 is a perspective diagram of an embodiment of a resilient lining material.
Figure 30:
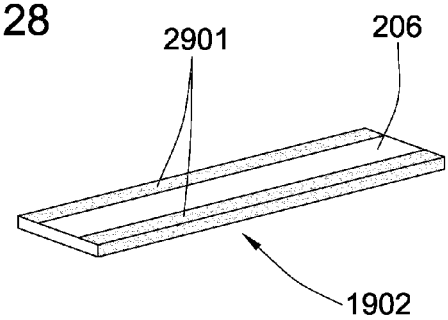
FIG. 30 is a perspective diagram of another embodiment of a resilient lining material.

FIGS. 29 and 30 disclose embodiments of strip 206 in which at least a portion of the strip comprises a surface texture 2901. In FIG. 29 an end 2902 comprises the surface texture 2901. End 2902 may be a first or second end 408, 501 of a first or second strip 406, 407. In such embodiments surface texture 2901 may aid in the connection of end 2901 to another end of another strip to form a continuous strip 206. FIG. 30 discloses surface texture 2901 disposed along longitudinal edge 1902 of strip 206. This may aid adjacent overlapping tubular segments 1402 in combining to form liners 811.

Figure 31:
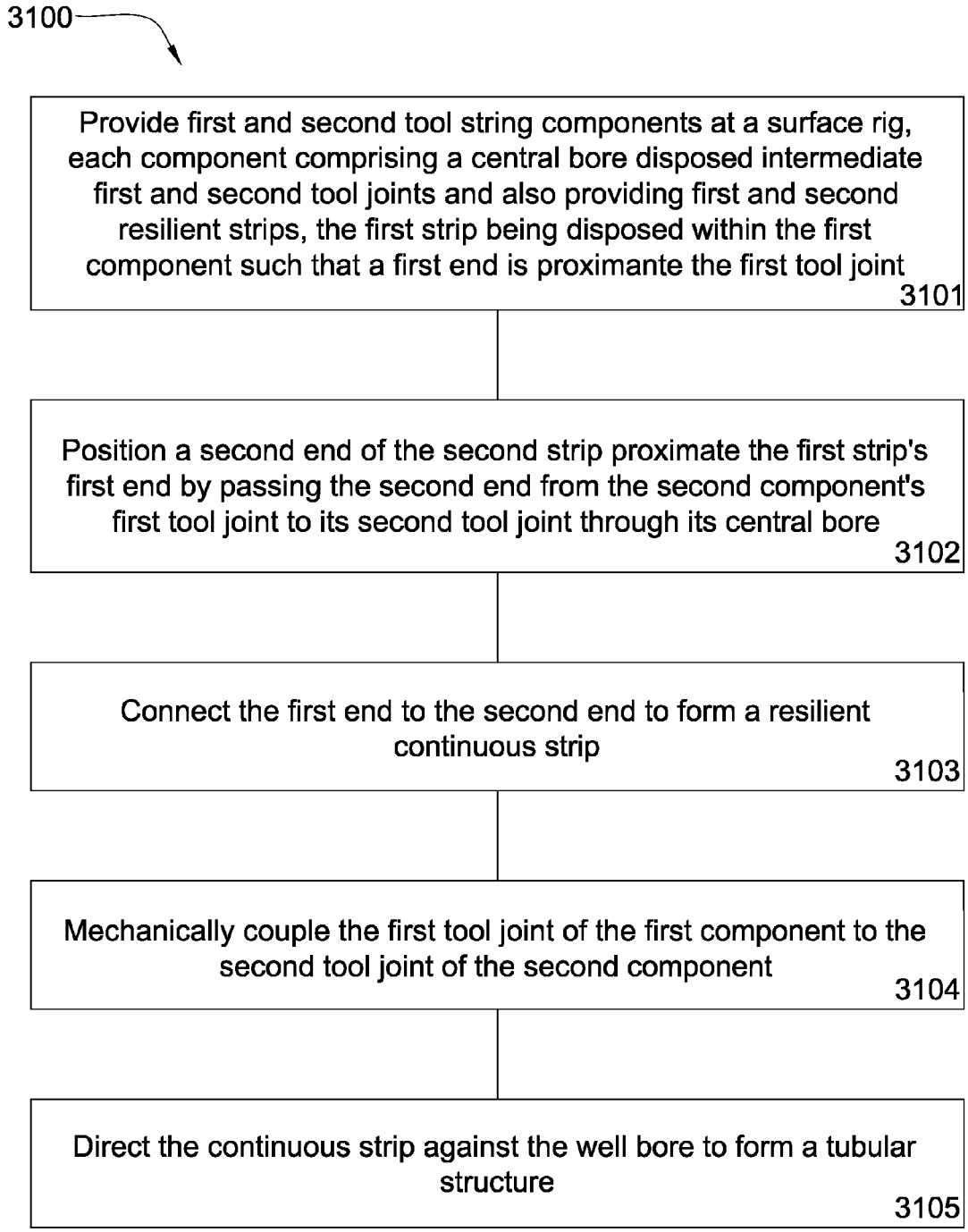
FIG. 31 is a flowchart illustrating a method of forming a liner downhole within a well bore.

Referring now to FIG. 31, a method 3100 of forming a liner 811 downhole within a well bore 101 comprises a step 3101 of providing first and second tool string components 301, 302 at a surface rig 108. Each component comprises a central bore 304 disposed intermediate first and second tool joints 305, 306. Step 3101 also comprises providing first and second resilient strips 406, 407. The first strip 406 is disposed within the first component 301 such that a first end 408 of the first strip 406 is proximate the first tool joint 305. Method 3100 further comprises a step 3102 of positioning a second end 501 of the second strip 407 proximate the first strip's first end 408 by passing the second end 501 from the second component's first tool joint 305 to its second tool joint 306 through its central bore 304. Method 3100 further comprises step 3103 of connecting the first end 408 to the second end 501 to form a resilient continuous strip 206. Step 3103 may comprise welding, crimping, indenting, hooking, heating, bolting, interlocking, jacketing, or combinations thereof. Method 3100 further comprises step 3104 of mechanically coupling the first tool joint 305 of the first component 301 to the second tool joint 306 of the second component 302 and step 3105 of directing the continuous strip 206 against the well bore 101 to form a liner 811.

Step 3101 may further comprise cutting one resilient continuous strip 206 that extends from the driving mechanism 201 into the central bore 304 of the first component 301 into a first portion 404 and a second portion 405. First and second portions 404, 405 may be detached from one another by cutting, snipping, crimping, sawing, bending, heating, unhooking, using a water jet cutter, using a sheer cutter, or combinations thereof.

Step 3102 may further comprise retaining the first strip 406 proximate the first tool joint 305 of the first component 301 while passing the second strip 407 through the central bore 304 of the second component 302. This may be accomplished using one or more retention devices 402. Step 3103 may comprise welding, crimping Step 3105 may further comprise conveying the strip 206 downhole using at least one roller 801, pulley 207, spool 205, deflection plate 804, deflection piston, motor, cam shaft, magnet, or combinations thereof.

Whereas the present invention has been described in particular relation to the drawings attached hereto, it should be understood that other and further modifications apart from those shown or suggested herein, may be made within the scope and spirit of the present invention.

What is claimed is:

1. A system for forming a liner downhole within a well bore, comprising:

a rig comprising a tool string driving mechanism and an aperture proximate an opening of a well bore;

first and second tool string components each comprising a central bore, a first tool joint of the first component being disposed proximate the aperture and a second tool joint of the second component;

first and second resilient lining material being disposed within the central bore of the first and second tool string components respectively;

at least one lining material connecting mechanism disposed proximate the aperture; and at least one downhole dispenser adapted to direct a resilient continuous lining material against the well bore to form a liner;

wherein the connecting the first and second liner materials forms a continuous lining material that is disposed within the bores of both the first and second components.

2. The system of claim 1, wherein the system comprises a lining material cutting mechanism disposed proximate the aperture.

3. The system of claim 1, wherein the lining material is selected from the group consisting of strips, tubes, split tubes, corrugated tubes, wires, braded wires, cables, and combinations thereof.

4. The system of claim 1, wherein first and second portions of one resilient lining material are detached from one another and become respectively the first and second resilient lining material.

5. The system of claim 1, wherein the resilient continuous lining material extends from within the driving mechanism and through the bores of both the first and second components.

6. The system of claim 1, wherein the continuous lining material comprises a total lining material width and a dent width, the dent width being at least one fifth of the total lining material width.

7. The system of claim 1, wherein the dispenser comprises at least one guide block disposed within an outer diameter of a downhole component, which guide block changes a direction of flow of the resilient continuous lining material by between 65 and 115 degrees.

8. The system of claim 1, wherein the dispenser is powered by a downhole mud motor.

9. The system of claim 1, wherein the dispenser is powered by rotation of the tool string caused by the driving mechanism.

10. The system of claim 1, wherein the dispenser comprises an input switch that allows a power source for the dispenser to change between a downhole mud motor and the driving mechanism.

11. The system of claim 1, wherein the liner is a well-casing, a patch, a barrier, or combinations thereof.

12. The system of claim 1, wherein at least one tool string component form comprises an expandable reamer disposed intermediate the downhole dispenser and a drill bit.

13. The system of claim 1, wherein at least one tool string component comprises a bi-center drill bit.

14. The system of claim 1, wherein the first and second liner materials connected by a diagonal weld joint.

15. A method of forming a liner downhole within a well bore, comprising:

providing first and second tool string components at a surface rig, each component comprising a central bore disposed intermediate first and second tool joints and also providing first and second resilient lining materials, the first lining material being disposed within the first component such that a first end is proximate the first tool joint;

positioning a second end of the second lining material proximate the first lining material's first end by passing the second end from the second component's first tool joint to its second tool joint through its central bore;

connecting the first end to the second end to form a resilient continuous lining material;

mechanically coupling the first tool joint of the first component to the second tool joint of the second component; and directing the continuous lining material against the well bore to form a liner.

16. The method of claim 15, wherein the step of positioning the second end of the second lining material proximate the first end of the first lining material further comprises retaining the first lining material proximate the first tool joint of the first component while passing the second lining material through the central bore of the second component.

17. The method of claim 15, wherein the step of directing the continuous lining material against the well bore comprises conveying the first lining material downhole using at least one roller, pulley, spool, deflection plate, deflection piston, motor, cam shaft, magnet, or combinations thereof.

18. The method of claim 15, wherein the step of connecting the first and second lining materials comprises welding, crimping, indenting, hooking, heating, or combinations thereof.

19. The method of claim 15, wherein the step of providing first and second resilient lining materials further comprises cutting one resilient continuous lining material that extends from a tool string driving mechanism into the central bore of the first component into a first portion and a second portion.

20. The method of claim 19, wherein the first and second portions are detached from one another by cutting, snipping, crimping, sawing, bending, heating, unhooking, using a water jet cutter, using a sheer cutter, or combinations thereof.

* * * * *